US005944275A

United States Patent [19]

Hauck

[11] Patent Number: 5,944,275

[45] Date of Patent: Aug. 31, 1999

[54] DEVICE FOR FORMING LOOPS FROM A WIRE STRAND EMERGING FROM A WIRE ROLLING TRAIN BY MEANS OR A ROTATING LOOPER

[75] Inventor: Albert Hauck, Hilchenbach, Germany

[73] Assignee: SMS Schloemann-Siemag Aktiengesellschaft, Düsseldorf, Germany

[21] Appl. No.: 09/095,336

[22] Filed: Jun. 10, 1998

[30] Foreign Application Priority Data

Jun. 18, 1997 [DE] Germany ..... 197 25 774

[51] Int. Cl.[6] ..... B21C 47/14; B21C 47/24

[52] U.S. Cl. ..... 242/361; 242/363

[58] Field of Search ..... 242/361, 361.1, 242/361.2, 361.3, 361.4, 361.5, 363; 72/66, 135

[56] References Cited

U.S. PATENT DOCUMENTS

| | | | |
|---|---|---|---|
| 1,295,139 | 2/1919 | Edwards | 242/361.3 |
| 3,390,871 | 7/1968 | McLean et al. | 242/361 |
| 3,490,500 | 1/1970 | Dopper et al. | 242/361.1 |
| 4,090,383 | 5/1978 | Properzi | 242/361.3 |
| 4,644,773 | 2/1987 | Duri | 72/135 |
| 5,238,199 | 8/1993 | Ossoinig et al. | 242/361.4 |
| 5,312,065 | 5/1994 | Shore et al. | 242/361 |

*Primary Examiner*—John M. Jillions
*Attorney, Agent, or Firm*—Friedrich Kueffner

[57] ABSTRACT

A device for forming loops from a wire strand emerging from a wire rolling train using a rotating looper, wherein the device includes a conveyor onto which the loops are placed while the conveyor is moving, wherein a driving unit, a looper and a roller conveyor, a chain conveyor or the like, are arranged following the wire rolling train and wherein the driving unit and possibly also the looper are arranged inclined relative to the horizontal. The driving unit and the looper are arranged at a fixed predetermined angle of inclination relative to the horizontal, while the conveyor on which the loops are placed is constructed so that its angle is adjustable relative to the horizontal.

9 Claims, 1 Drawing Sheet

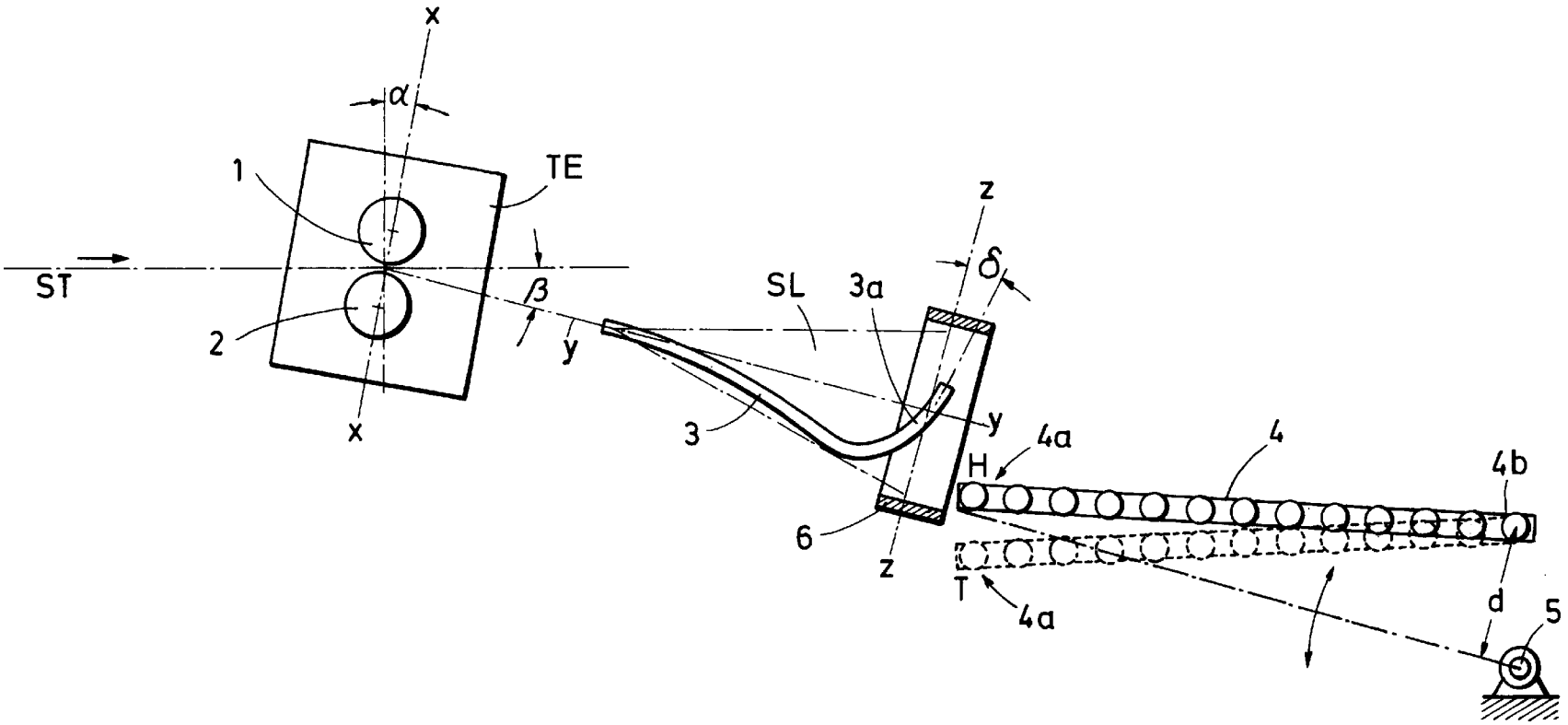
ST
1
2
x
x
α
TE
β
y
y
3
SL
3a
z
z
δ
6
H
4a
4a
T
4
4b
d
5

DEVICE FOR FORMING LOOPS FROM A WIRE STRAND EMERGING FROM A WIRE ROLLING TRAIN BY MEANS OR A ROTATING LOOPER

BACKGROUND OF THE INVENTION

1. Field of the Invention

The present invention relates to a device for forming loops from a wire strand emerging from a wire rolling train by means of a rotating looper, wherein the device includes a conveyor onto which the loops are placed while the conveyor is moving, wherein a driving unit, a looper and a roller conveyor, a chain conveyor or the like, are arranged following the wire rolling train and wherein the driving unit and possibly also the looper are arranged inclined relative to the horizontal.

2. Description of the Related Art

Modern wire rolling trains operate with ever increasing final speeds, particularly when rolling wire having a small diameter. Final speeds of more than 100 m/s are reached. On the other hand, ever increasing dimensions are also rolled, with wire diameters of up to more than about 25 mm.

These very different rolling parameters produce problems when the wire loops of the finished wire are placed on the conveyor.

In accordance with the prior art, the looper is usually arranged in a fixed manner at an angle of about 10° relative to the horizontal and the driving unit arranged in front of the looper is arranged either extending horizontally or also at the same or a smaller angle relative to the horizontal.

In order to achieve a problem-free placement of the loops of wire having a small diameter at a very high speed, on the one hand, and of wire having a large diameter at low speeds, on the other hand, a looper has been proposed in the art whose inclination relative to the horizontal was adjustable. For example, the angle of inclination is 10° for high wire speeds and the inclination is up to 30° for low wire speeds.

However, this solution resulted in the following significant disadvantages. The different inclinations require correspondingly changed distances from the horizontal guide planes; in other words, differently adjusted deflecting guide means must me used depending on the wire speed. In addition, pivotable support structures for the driving unit and for the looper are required. These support structures are not only technically cumbersome, but they are susceptible to vibrations at high speeds.

SUMMARY OF THE INVENTION

Therefore, it is the primary object of the present invention to improve a device of the above-described type in such a way that a problem-free placement of the loops of wires having small diameters and also large diameters is possible while avoiding the pivotable support structures and the various deflecting guide means as well as the susceptibility to vibrations of the support structures.

In accordance with the present invention, the driving unit and the looper are arranged at a fixed predetermined angle of inclination relative to the horizontal, while the conveyor on which the loops are placed is constructed so that its angle is adjustable relative to the horizontal.

In accordance with an advantageous feature, the pivot axis for the pivot angle adjustment of the conveyor is located at a distance underneath the end of the conveyor remote from the end which receives the loops, while the drive of the driving unit can be regulated, for example, through pressure-regulated pneumatic piston-cylinder units, and the positions of the support rollers are adjustable through adjusting elements, such as adjusting screws.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing schematically illustrates the device according to the present invention with driving unit, looper and conveyor.

DESCRIPTION OF THE PREFERRED EMBODIMENTS

A wire strand ST emerges in the direction of the arrow shown on the left hand side of FIG. 1 from a wire rolling train, not shown. A driving unit TE with the drive rollers 1 and 2 is arranged following the exit of the wire rolling train. The common plane x—x extending through the axes of the rollers is located at an angle $\alpha$ relative to the vertical. The looper SL is arranged following the driving unit TE. The axis of rotation y—y of the placement tube 3 extends at an angle $\beta$ relative to the horizontal, while the placement arm 3*a* of the placement tube 3 extends at an angle $\delta$ relative to the plane of rotation z—z of the placement arm.

The conveyor, i.e., a roller conveyor 4 in the illustrated embodiment, is mounted so as to be pivotable about the pivot axis 5 which is located at a distance d below the end 4*b* of the roller conveyor 4 remote from the end 4*a* which receives the loops, in a vertical plane between an upper position H shown in solid lines and a lower position T shown in broken lines.

Before the beginning of the wire strand enters the drive unit, the drive rollers 1, 2 rotate with a somewhat higher speed than would correspond to the expected speed of the wire, and the gap between the rollers 1, 2 is dimensioned slightly greater than the wire diameter. The drive rollers 1, 2 are closed once the beginning of the wire has passed the rollers 1, 2 and has been deflected downwardly by guide means, not shown, following the drive rollers 1, 2. The inclined arrangement of the common plane of the axes of the drive rollers 1, 2 produces a bending effect of the wire in addition to the driving effect. This bending effect is greater in the case of wire having a large diameter because the lever arm with which the drive rollers 1, 2 act on the wire entering in a horizontal plane is greater, i.e, the bending moment increases with increasing wire diameter. This facilitates the deflection of the wire and reduces the resulting friction losses.

In addition to carrying out the deflection work described above, the drive rollers 1, 2 must also drive the ends of wires having greater diameters after these wires have left the wire train and accelerate the wires for compensating for the work carried out in the placement tube 3. This is reinforced by the inclined arrangement of the drive rollers 1, 2.

The loops are initially formed in the placement arm 3*a* of the placement tube 3 which also determines the diameter of the loops. The fact that loops emerge at an angle $\beta$ relative to the plane of rotation produces a movement of the emerging loops in the direction toward the axis of rotation y—y of the placement arm 3*a* which reaches up to 5 m/s at high speeds of the wire. These speeds are reached in the case of wires having small diameters. In the hot-rolled state, these wires have a low stability. In order to achieve a problem-free placement of the loops on the roller conveyor 4 in spite of this low stability, the roller conveyor 4 is lowered into the lower position T. In this lower position T, the roller conveyor 4 decelerates the loops placed on the conveyor 4 only to a small extent, so that no deformations of the wire occur.

When placing loops of wires having greater diameters, the speed of movement of the wires is low in the direction toward the axis of rotation y—y of the placement arm 3*a*. Because of the greater wire diameter, these loops have a greater stiffness. Therefore, in this case, the roller conveyor 4 is pivoted up into the upper position H. This causes the loops to be decelerated to a much greater extent directly after they have left the placement arm 3*a* and, thus, a timely placement of the loops on the roller conveyor 4 is ensured.

The position of the pivot axis 5 of the roller conveyor 4 is selected in such a way that, when the roller conveyor 4 is raised and lowered, the first roller 4*a* of the roller conveyor 4 always has the most favorable distance from the placement arm 3*a* or its fixed guide ring 6.

While specific embodiments of the invention have been shown and described in detail to illustrate the inventive principles, it will be understood that the invention may be embodied otherwise without departing from such principles.

I claim:

1. In a device for forming loops from a wire strand emerging from a wire rolling train, the device including a rotating looper and a conveyor configured to convey the loops as they are placed on the conveyor, wherein a drive unit, the looper and the conveyor are arranged following the wire rolling train, and wherein the looper is arranged so as to be inclined relative to a horizontal direction, the improvement comprising the drive unit and the looper being mounted so as to be in a fixed position, and the conveyor receiving the loops being configured so as to have an adjustable pivot angle relative to the horizontal direction.

2. The device according to claim 1, wherein the drive unit is arranged inclined relative to the horizontal.

3. The device according to claim 1, wherein the conveyor is a roller conveyor.

4. The device according to claim 1, wherein the conveyor is a chain conveyor.

5. The device according to claim 1, wherein a pivot axis for the adjustment of the pivot angle of the conveyor is arranged at a distance underneath an end of the conveyor remote from an end of the conveyor receiving the loops.

6. The device according to claim 1, wherein the drive unit comprises a regulatable drive.

7. The device according to claim 6, wherein the drive unit comprises two drive rollers configured to be driven by the drive, further comprising pressure-regulatable pneumatic-piston cylinder units for effecting a contact pressure between the rollers.

8. The device according to claim 7, further comprising adjusting elements for adjusting positions of the drive rollers of the drive unit.

9. The device according to claim 8, wherein the adjustment elements are adjustment screws.

* * * * *